US005673542A

United States Patent [19]

Vartanian et al.

[11] Patent Number: 5,673,542

[45] Date of Patent: Oct. 7, 1997

[54] APPARATUS FOR WRAPPING VARIOUSLY-SIZED ARTICLES

[76] Inventors: Armond Vartanian, 3094 Seahorse Ave., Ventura, Calif. 93001; Jacques C. Laganiere, 14210 Gager St., Arleta, Calif. 91331

[21] Appl. No.: 559,202

[22] Filed: Nov. 13, 1995

[51] Int. Cl.[6] ..... B65B 53/00

[52] U.S. Cl. ..... 53/556; 53/588; 53/390

[58] Field of Search ..... 53/399, 441, 556, 53/588, 592, 589, 390, 210, 465, 585

[56] References Cited

U.S. PATENT DOCUMENTS

| | | | |
|---|---|---|---|
| 2,743,562 | 5/1956 | Dawson et al. | 53/588 X |
| 2,945,336 | 7/1960 | Anderson et al. | 53/588 |
| 4,050,220 | 9/1977 | Lancaster et al. | 53/588 X |
| 4,079,565 | 3/1978 | Lancaster et al. | 53/441 |
| 4,429,514 | 2/1984 | Lancaster et al. | 53/588 X |
| 4,593,518 | 6/1986 | Lancaster | 53/588 X |
| 4,620,408 | 11/1986 | Parnes | 53/588 X |
| 4,658,570 | 4/1987 | Thomas | 53/588 X |
| 4,694,636 | 9/1987 | Griffin | 53/588 X |
| 4,829,750 | 5/1989 | Cassidy | 53/585 X |
| 4,949,533 | 8/1990 | Bate | 53/588 X |

FOREIGN PATENT DOCUMENTS

| | | | |
|---|---|---|---|
| 6056128 | 3/1994 | Japan | 53/588 |

*Primary Examiner*—Linda Johnson
*Attorney, Agent, or Firm*—Freilich, Hornbaker Rosen

[57] ABSTRACT

An apparatus for wrapping one or more variously-sized articles from a roll of web material, e.g., elastic plastic material, by supporting the articles on an adjustable support assembly while orbitally rotating the web material roll around the articles. A preferred apparatus in accordance with the present invention is characterized by an article support assembly comprised of a pair of arms at substantially right angles each having a plurality of elongate V-shaped fingers adjustably positioned on said arms and extending at substantially right angles to said arms wherein one or more articles are supported by said fingers during a wrapping operation.

11 Claims, 5 Drawing Sheets

APPARATUS FOR WRAPPING VARIOUSLY-SIZED ARTICLES

BACKGROUND OF THE INVENTION

The present invention relates generally to apparatus for orbitally wrapping articles, especially rectilinear boxes, with web material, e.g., an elastic plastic material.

U.S. patents directed to devices intended for orbitally wrapping articles include U.S. Pat. Nos. 4,166,348; 4,620,408; and 4,949,533. Additional U.S. patents directed to wrapping devices include U.S. Pat. Nos. 2,945,336; 2,962,853; 4,067,174; 4,079,565; 4,317,322; 4,369,614; 4,712,354; 7,722,170; 4,723,393, 4,756,143; 4,829,750; 5,027,581; 5,195,301; 5,212,933; and 5,351,461.

SUMMARY OF THE INVENTION

The present invention is directed to apparatus for wrapping one or more variously-sized articles with material from a roll of web material, e.g., elastic plastic material, by supporting the articles on an adjustable support assembly while orbitally rotating the web material roll around the articles.

An apparatus in accordance with the invention is primarily comprised of: 1) a spindle for supporting a roll of web material, 2) means mounting said spindle for orbital movement around an axis oriented substantially parallel to said spindle and displaced therefrom, and 3) an article support assembly mounted so as to be circumscribed by said orbital movement for supporting an article to be wrapped by web material fed from said roll, wherein said article support assembly includes a plurality of elongate fingers, each finger being oriented substantially parallel to said axis, said plurality of fingers being arranged along first and second substantially orthogonally related rows.

In a preferred embodiment, the elongate fingers are V-shaped and are positionable along each of the respective rows to further adapt to the variously-sized packages.

In a further aspect of a preferred embodiment, the height of the support assembly is adjustable to adapt to variously-sized operators.

In a still further aspect of a preferred embodiment, the wrapping shaft assembly includes means for adjusting rotational dispensing friction on said roll of web material to adjust the tension on said web material during a wrapping operation.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
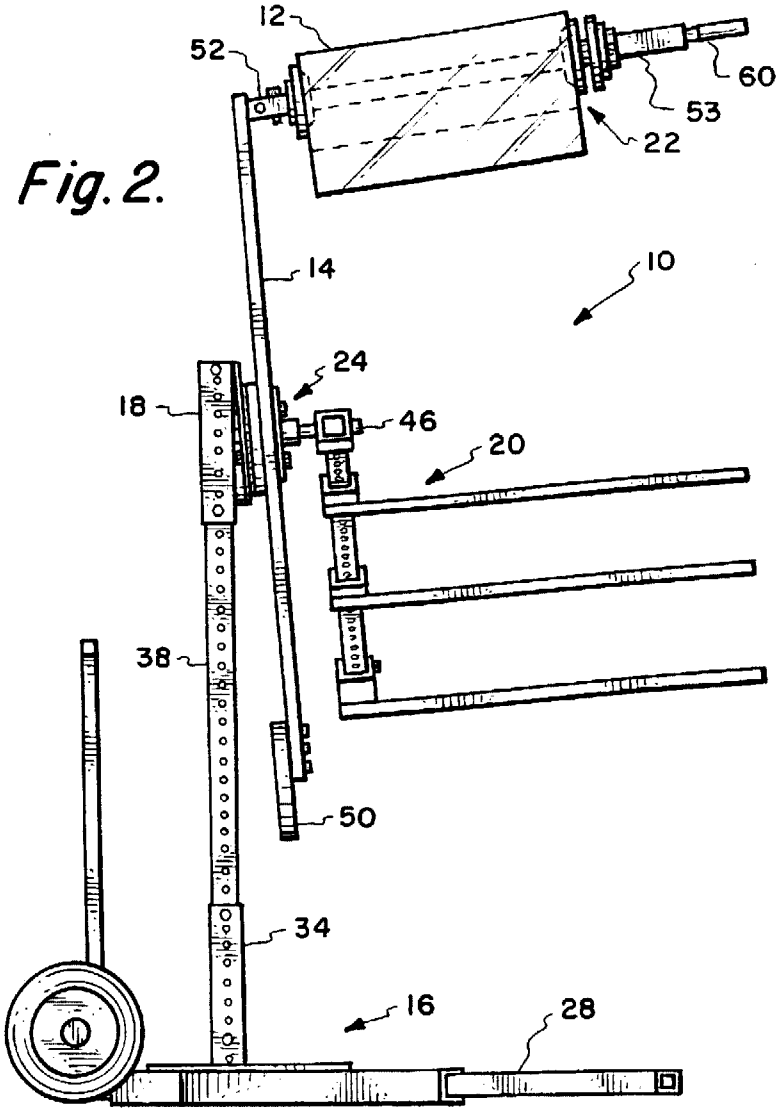
FIG. 2 is a side view of the embodiment of FIG. 1.
Figure 1:
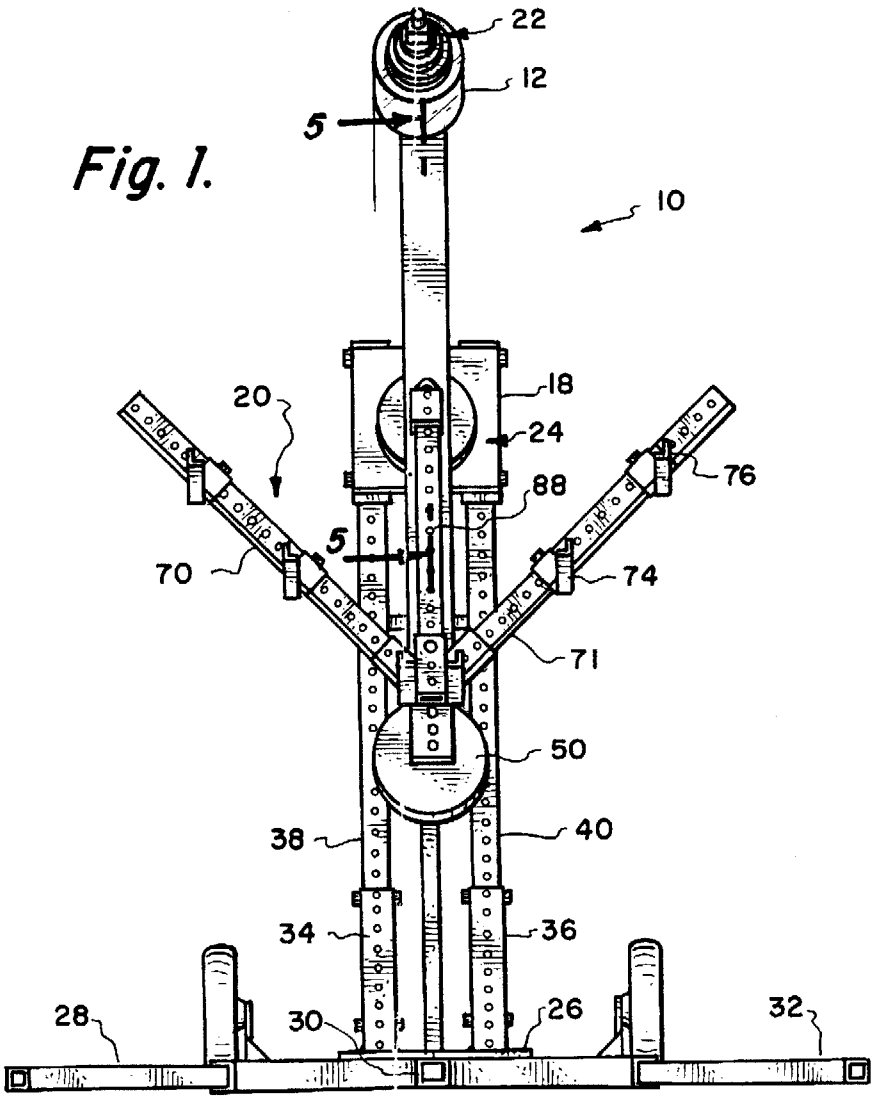
FIG. 1 is a front view of a preferred embodiment of the present invention that adjustably supports one or more articles while web material is orbitally rotated on a wrapping arm around said articles.
Figure 3:
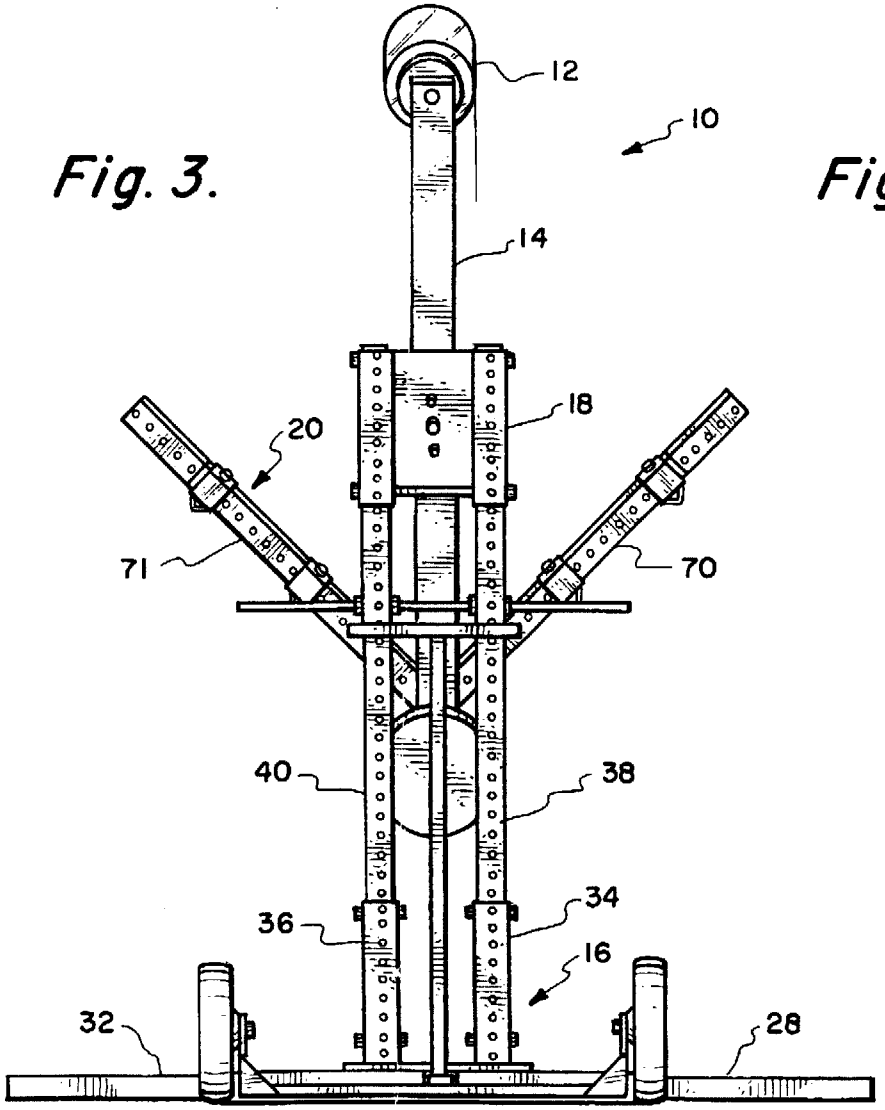
FIG. 3 is a rear view of the embodiment of FIG. 1.

FIGS. 1–3 are respectively front, side, and rear views of a preferred wrapping apparatus 10 that adjustably supports one or more articles, e.g., rectilinear boxes, while a roll of web material 12, e.g., elastic plastic material, is orbitally rotated on a wrapping arm 14 around said articles. The preferred wrapping apparatus 10 is primary comprised of 1) a base assembly 16, 2) a head assembly 18 adjustably carried by the base assembly 16, 3) an article support assembly 20 carried by the head assembly 18 for adjustably supporting one or more articles, and 4) a wrapping assembly comprised of a dispensing assembly 22 for resistantly dispensing the web material 12, and a rotating arm assembly 24 for orbitally rotating the dispensing assembly 22 around articles supported by the article support assembly 20.

Figure 4:
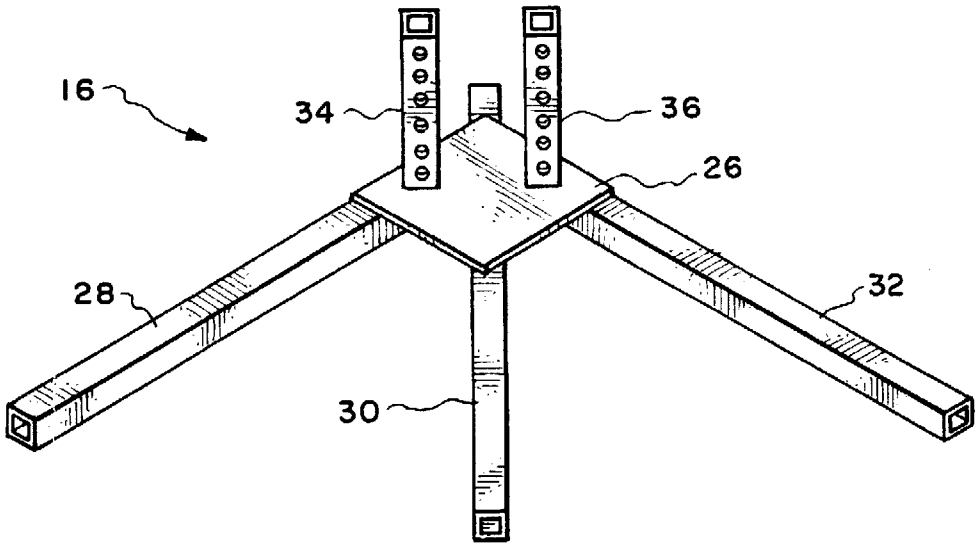
FIG. 4 is a partially exploded isometric view of a base assembly for a preferred embodiment.

FIG. 4 shows a partially exploded isometric view of the base assembly 16. The base assembly is essentially comprised of a bottom platform 26, supported by legs 28, 30, and 32, preferably rectangular tubing, and a pair of vertical support sleeves 34, 36, preferably apertured rectangular tubing. The vertical support sleeves 34, 36 are extended by vertical support extensions 38, 40, preferably apertured rectangular tubing, which are fixedly coupled, e.g., by pins, to the vertical support sleeves 34, 36. The primary purpose of the base assembly 16 is to support the rest of the apparatus at a fixed location. However, as shown in FIG. 2, a wheeled assembly can be coupled to the base assembly 16 to allow transport of the apparatus to a new fixed location.

The head assembly 18 contains slots which adjustably receive the vertical support extensions 38, 40. The head assembly is fixedly coupled, e.g., by pins, to the vertical support extensions 38, 40. The height of the article support assembly 20 (and therefore the articles) and the rotating arm assembly 24 can thus be altered to conform to the height of an operator who uses the wrapping apparatus 10. This alteration is done by selecting the apertures used for coupling the vertical support extensions 38, 40 to the head assembly and/or the vertical support sleeves 34, 36.

Figure 5:
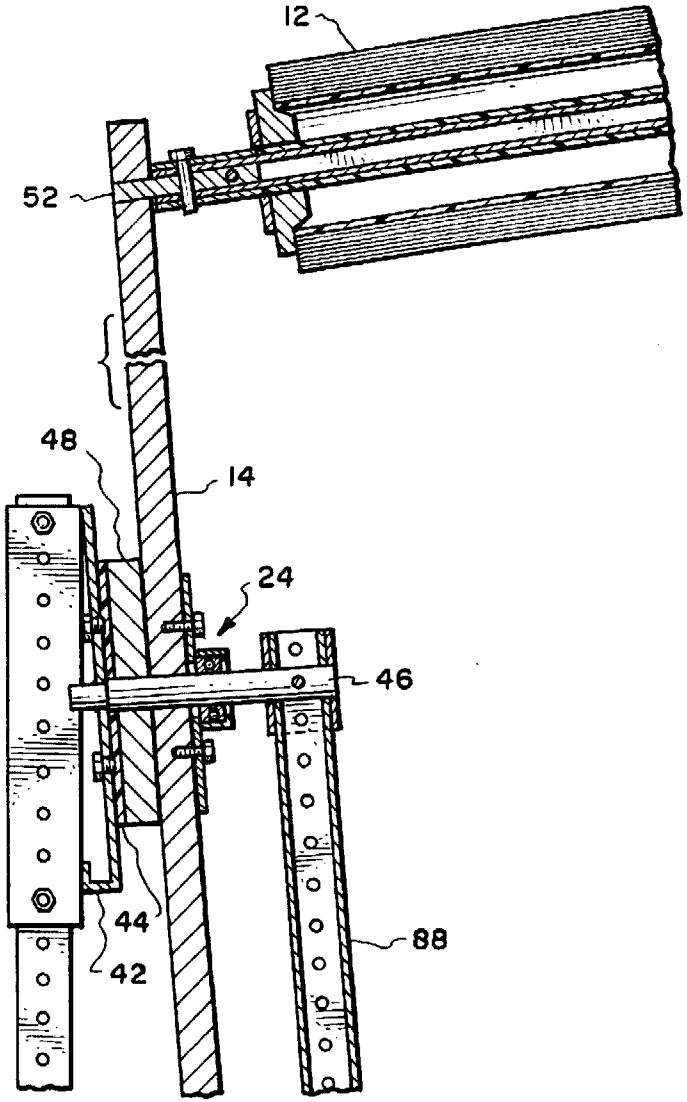
FIG. 5 is a cross sectional view essentially along the along the plane 5—5 showing a braking apparatus on said wrapping arm.

As best shown in FIG. 5, the head assembly 18 additionally comprises a face plate 42 (preferably angled slightly), a brake pad 44 and a wrapping arm axle 46 coupled to the face plate 42. The rotating arm assembly 24 is rotatably positioned on the wrapping arm axle 46. The rotating arm assembly 24 is primarily comprised of the wrapping arm 14, a brake plate 48, fixedly coupled to the wrapping arm 14, and a counterbalance weight 50 (see FIG. 2) coupled to a first end of the wrapping arm 14 to offset the weight of the dispensing assembly 22 which is coupled to a second end of the wrapping arm 14. The brake plate 48 is frictionally coupled to the brake pad 44 to resist movement of the wrapping arm 14 around the wrapping arm axle 46.

Figure 6:
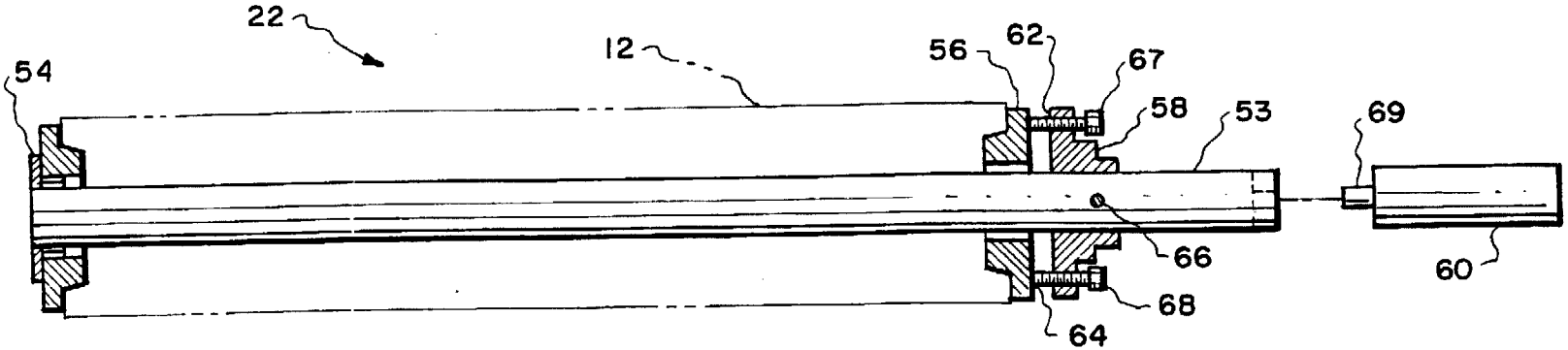
FIG. 6 is a partially exploded view of a dispensing assembly for a preferred embodiment.

The dispensing assembly 22 (FIG. 6) is primarily comprised of an inner wrapping arm axle 52, i.e., a spindle, (see FIGS. 2 and 5) fixedly coupled to the wrapping arm 14 and surrounded by an outer wrapping arm axle 53. The outer wrapping arm axle 53 has first and second roll holder end plates 54, 56 mounted thereon, a looking plate 58, and a handle 60. Axles 52, 53 and the corresponding inner receptacles for each plate 54, 56, and 58 are preferably rectilinear and thus inhibit any relative rotation. A roll of web material 12, preferably wrapped around a cardboard core, is held between the end plates 54, 56. End plate 54 preferably abuts a flared end of outer wrapping arm axle 53. The locking plate 58 serves two functions. First, it determines the axial position of the outer wrapping arm axle 53 relative to the inner wrapping arm axle 52 and second, it determines the dispensing friction on the roll of web material 12. To accomplish these functions, the locking plate 58 is first located proximate to the outer end plate 56, the axle 53 is moved axially to select the desired axial position and then a screw is tightened into locking hole 66. Next, once the axial position has been selected, screws 67 and 68 are tightened through threaded holes in the locking plate 58 against the outer end plate 56 to adjust a compression force between the end plates 54, 56 on the cardboard core of the web material 12. As the compression is increased, the dispensing resistance also increases.

The handle 60 is coupled to the end of the outer wrapping arm axle 53 to provide an operator an extension sufficiently clear of the article support assembly 20. The handle 60 is preferably free to rotate around shaft 69.

Figures 7, 9:
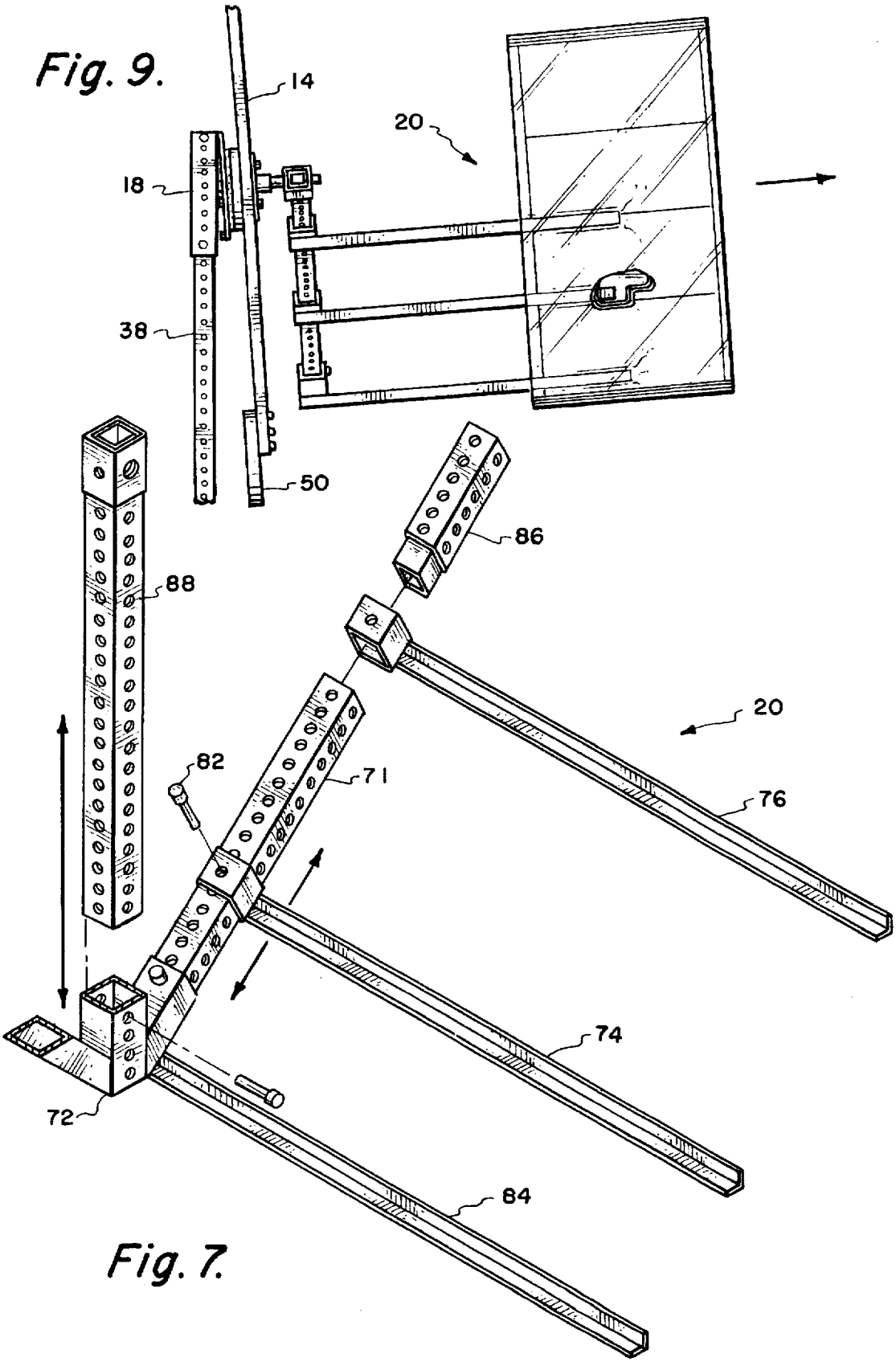
FIG. 7 is a partially exploded view of a preferred adjustable support assembly for the present invention.
FIG. 9 shows articles wrapped in the wrapping operation of FIGS. 8*a*–8*c* being withdrawn from the adjustable support fingers.

FIG. 7 is a partially exploded isometric view of one side of the adjustable article support assembly 20. The article support assembly 20 is primarily comprised of a pair of article support arms 70, 71, whose first ends are fixedly coupled at substantially right angles with a coupling bracket 72. Attached to each article support arm are a plurality of elongate V-shaped support fingers 74, 76 that are adjustably coupled to the article support arms 70, 71. The article support arms 70, 71 are preferably formed of apertured rectangular tubing. The V-shaped support fingers 74, 76 are coupled to apertured sleeves 78, 80 that can slide on the article support arms 70, 71. Once a desired position is determined, the support fingers 74, 76 are fixedly coupled to the article support arm 71, e.g., a pin 82 is slid through the aperture in the sleeve 78 into a matching aperture in the article support arm 71. Additional support fingers, e.g., support finger 84, can also be fixedly attached to each article support arm 70, 71 or the coupling bracket 72. Additionally, article support arms 70, 71 can be extended via an arm extension 86 to accommodate a larger size article or group of articles.

The article support arms 70, 71 are preferably coupled via the coupling bracket 72 and a support arm 88 to the head assembly 18 where the support arm 88 is supported on the wrapping arm axle 46. Alternatively, a cross member arm (not shown) can couple second ends of the article support arms 70, 71 (forming a triangle) and the center of the cross member arm can be coupled to the wrapping arm axle 46 to support the article support assembly or a plate with perpendicular slots can adjustably accept the support fingers in two sets of orthogonal rows, such that fingers in each set are collinear.

Figure 8A:
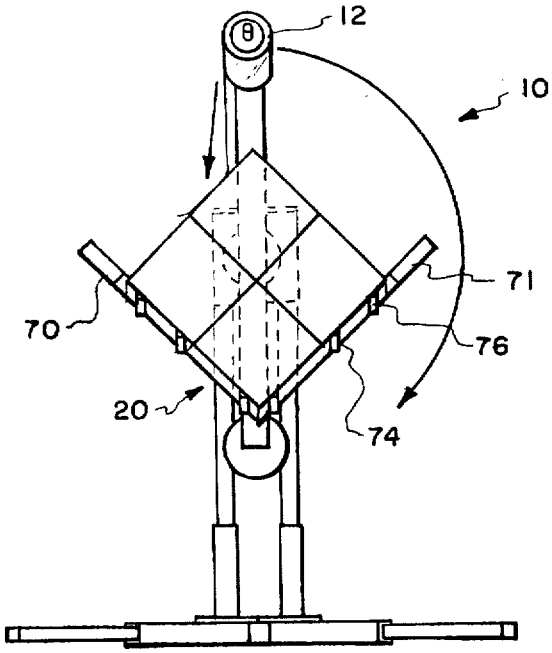
FIGS. 8*a*–8*d* show progressive front views of a wrapping operation performed with the present invention.
Figure 8B:
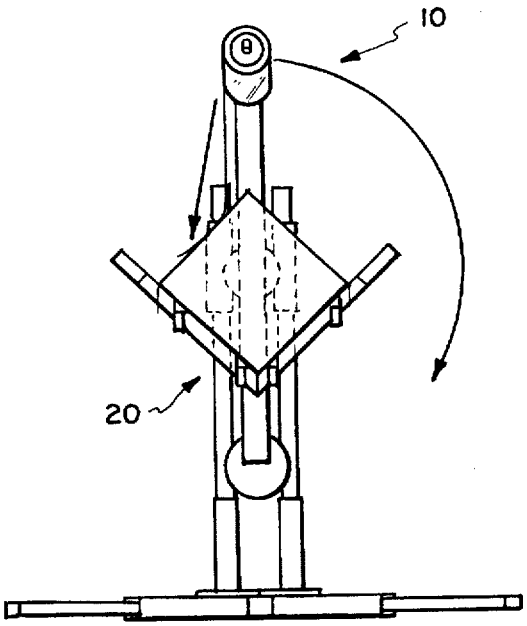
Figure 8D:
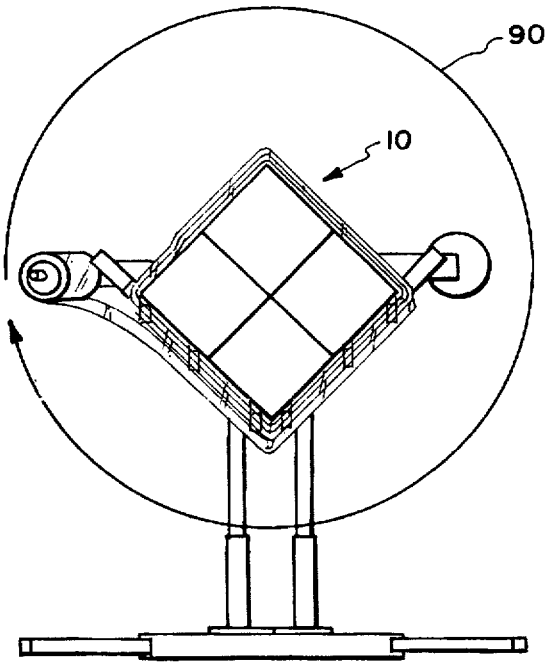
Figure 8C:
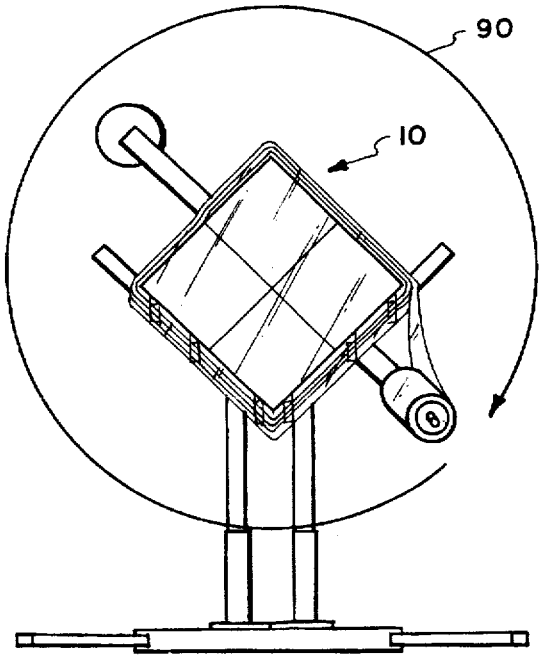

FIGS. 8*a*–8*d* and FIG. 9 demonstrate the use of the present invention. As shown in FIG. 8*a*, a plurality of articles are stacked together within the article support assembly 20. Alternatively, as shown in FIG. 8*b*, a single article can be placed within the article support assembly 20. An essentially rectangular article, e.g., a box or group of boxes, is shown placed at an angle between the article support arms 70, 71 and supported on the open side (the side opposite the vertex) of each V-shaped finger. The web material, e.g., an elastic plastic web, is attached to the articles and manual rotation (clockwise or counterclockwise) of the counterweighted rotating arm assembly 24 is started. As previously described, the tension on the web material is adjustable within the dispensing assembly 22 by adjusting the contact between the end plate 56 and the locking plate 58. The rotation continues on an arc 90 surrounding the article support assembly 20, as shown in FIGS. 8*c* and 8*d* until sufficient web material 12 has been wrapped around the articles. The web material 12 is then cut and the wrapped articles are then slid away from the article support assembly 20 (see FIG. 9). Afterwards, the wrapped articles can be rotated 90 degrees and reinserted on the article support assembly 20 to further wrap the articles.

The V-shape of the support fingers facilitates the removal of the wrapped articles from the article support assembly 18. Due to the shape of the support fingers, the web material 12 makes primary contact with the support fingers at their vertices. Similarly, the opposing outer points at the top of each V-shaped support finger are the primary contact points with the article. Thus, due to these limited points of contact and the elasticity of the web material, the capability for removing the wrapped articles is enhanced. While V-shaped support fingers are currently preferred, alternative shapes are considered to be within the scope of the present invention when they are distributed in two collinear sets of support fingers substantially orthogonal to each other.

The preferred embodiments of the invention described herein are exemplary and numerous modifications and rearrangements can be readily envisioned to achieve an equivalent result, all of which are intended to be embraced within the scope of the appended claims. For example, while a manually operated apparatus has been shown, motorized embodiments are also considered to be within the scope of the present invention.

We claim:

1. An apparatus for supporting one or more articles to facilitate wrapping said articles with web material, said apparatus comprising:

first and second elongate support arms mounted at substantially right angles to define a mounting plane;

a first elongate finger having first and second ends wherein said first end of said first elongate finger is coupled to said first support arm and said first elongate finger extends substantially orthogonally to said mounting plane, said first elongate finger and said first elongate support arm defining a first support plane; and a second elongate finger having first and second ends wherein said first end of said second elongate finger is coupled to said second support arm and said second elongate finger extends substantially orthogonally to said mounting plane and substantially parallel to said first elongate finger, said second elongate finger and said second elongate support arm defining a second support plane;

said first and second support planes being oriented relative to one another to define an upwardly opening interior angle therebetween of approximately 90° and said first and second elongate fingers being spaced from one another to permit a portion of an article to extend between said fingers for engagement by said web material as the article is being wrapped.

2. The apparatus of claim 1, wherein said first end of said first elongate finger is adjustably positionable along said first support arm and said first end of said second elongate finger is adjustably positionable along said second support arm.

3. The apparatus of claim 1, wherein said elongate fingers define a lateral V-shaped cross section.

4. The apparatus of claim 1, additionally comprising a plurality of first and second elongate fingers.

5. The apparatus of claim 1 additionally comprising:

a spindle for supporting a roll of web material; and means for mounting said spindle for orbital movement around an axis oriented substantially parallel to said spindle and displaced therefrom.

6. The apparatus of claim 5 including means for adjusting the spacing between said interior angle and said axis.

7. The apparatus of claim 5 including a head assembly defining said axis; and wherein said elongate fingers project forwardly from said head assembly sloping upwardly relative to said axis.

8. The apparatus of claim 5 additionally comprising a dispensing assembly mounted on said spindle for dispensing said web material from said roll.

9. The apparatus of claim 5 further including brake means for generating a force to resist said orbital movement of said spindle.

10. The apparatus of claim 1 wherein at least one of said first and second elongate fingers is comprised of first and second legs oriented orthogonal to one another to form a V-shaped cross section defining an outwardly oriented vertex for engaging the web material.

11. The apparatus of claim 5 including a base assembly; and means for adjusting the vertical height of said axis relative to said base assembly.

* * * * *